US006462728B1

(12) United States Patent
Janssen et al.

(10) Patent No.: US 6,462,728 B1
(45) Date of Patent: Oct. 8, 2002

(54) APPARATUS HAVING A DAC-CONTROLLED RAMP GENERATOR FOR APPLYING VOLTAGES TO INDIVIDUAL PIXELS IN A COLOR ELECTRO-OPTIC DISPLAY DEVICE

(75) Inventors: Peter J. Janssen, Scarborough, NY (US); John E. Dean, Stormville, NY (US); Lucian Remus Albu, New York City, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/469,449

(22) Filed: Dec. 21, 1999

(51) Int. Cl.[7] ..... G09G 3/36
(52) U.S. Cl. ..... 345/100; 345/89
(58) Field of Search ..... 345/589, 596, 345/89, 94, 95, 96, 99, 100

(56) References Cited

U.S. PATENT DOCUMENTS 4,766,430 A 8/1988 Gilette et al. ..... 340/793
5,712,651 A 1/1998 Tomiyasu
5,828,357 A 10/1998 Tamai et al.

*Primary Examiner*—Matthew Luu

(57) ABSTRACT

In an electro-optic display device, such as a liquid crystal display device which serves as a modulator for projected light, a global DAC controlled ramp generator is used in conjunction with track and hold circuit for each column of the display to convert incoming digital display signals to analog signals for all columns. Row address circuitry addresses each row of the display, thereby to address the individual pixels of the display device with such analog signals. The limitation on an increase in frame rate, resulting from the finite conversion time (cycle time) of the DAC, is overcome by reducing the grey scale resolution, thus reducing the number of times that the DAC must convert a digital number to an analog voltage during each ramp cycle, and restoring the original resolution using temporal "dithering"—i.e., interpolation between the brightness levels of pixels in successive frames.

4 Claims, 5 Drawing Sheets

| | | M NEW ( = SAMPLED VALUE ) | | | |
|---|---|---|---|---|---|
| | | L = 0 | L = 1 | L = 2 | L = 3 |
| FRAME 1 | i = 3 | M | M + 1 | M + 1 | M + 1 |
| FRAME 2 | i = 0 | M | M | M | M |
| FRAME 3 | i = 2 | M | M | M + 1 | M + 1 |
| FRAME 4 | i = 1 | M | M | M | M + 1 |

APPARATUS HAVING A DAC-CONTROLLED RAMP GENERATOR FOR APPLYING VOLTAGES TO INDIVIDUAL PIXELS IN A COLOR ELECTRO-OPTIC DISPLAY DEVICE

CROSS-REFERENCE TO RELATED APPLICATION

The subject matter of this application is related to that disclosed in the commonly assigned U.S. patent application Ser. No. 09/375,952, filed Aug. 17, 1999 entitled "DAC DRIVER CIRCUIT WITH PIXEL RESETTING MEANS AND COLOR ELECTRO-OPTIC DISPLAY DEVICE AND SYSTEM INCORPORATING SAME".

FIELD OF TECHNOLOGY

The invention relates to color display systems which employ one or more electro-optic display devices. Such a display device serves as a light modulator, either in the reflective or transmissive mode, to control the grey level of projected light at each pixel point. More particularly, the invention relates to such a color display system having digital-to-analog (DAC) controlled ramp generator circuitry to convert incoming digital display signals to analog signals, and circuitry to address the individual pixels of the display device with such analog signals.

BACKGROUND AND SUMMARY

Color display systems are known in which light bars of different colors are sequentially scrolled across a single electro-optic light modulator panel to produce a color display. See, for example, commonly assigned U.S. Pat. No. 5,532,763, incorporated herein by reference.

These display systems are particularly suitable for displaying color information in the form of continuously updated image information signals arranged in successive frames, such as color video information, in which each frame is composed of component color sub-frames, e.g., red, green and blue sub-frames.

These systems employ an electro-optic light modulator panel comprised of a row-and-column matrix array of pixels, for modulating light in accordance with the image information signals during successive frame periods. The analog signal information is applied to the pixel columns of the array, a row at a time, during each frame period.

A system of this type is also disclosed in the publication of J. A. Shimizu, "Single Panel Reflective LCD Projector", *Projection Displays V*, Proceedings SPIE, Vol. 3634, pp. 197–206 (1999). In such a system, a plurality of column pixel driver circuits receive a common ramp signal which is repeatedly generated, during a plurality of cycles, by the output buffer of a digital-to-analog converter (DAC) controlled ramp generator. Each column driver is coupled to all the pixels in a column of the electro-optic display device. During each ramp cycle, the column driver applies a prescribed voltage, corresponding to a desired pixel brightness level, to a pixel in a particular row in the respective column.

The pixels in a column are selected by a row control circuit which selects successive pixel rows during successive ramp cycles.

In a system of this type, the DAC controlled ramp generator becomes a performance "bottleneck" at higher frame rates (greater than 120 frames/second) which are desirable to reduce color artifacts and flicker. As the frame rate is increased, the finite conversion time (cycle time) of the DAC poses a limitation on the maximum speed of operation.

It is a principal object of the present invention to provide a circuit which will permit an increase in the frame rate in an electro-optic display without increasing the speed of the DAC, without increasing the cost of hardware, and without reducing the number of grey levels (brightness levels) which can be applied to each pixel.

This object, as well as other objects which will become apparent from the discussion that follows, are achieved, in accordance with the present invention, (1) by reducing the grey scale resolution, thus reducing the number of times that the DAC must convert a digital number to an analog voltage during each ramp cycle, and restoring the original resolution using "temporal dithering"—i.e., interpolation between the brightness levels of pixels in successive frames—and/or (2) by providing a multi-phase clock and multiplexer which enables a selection from among several analog levels during each clock cycle (DAC conversion).

The present invention thus affords an improvement in speed in a system for applying various levels of voltage to the individual pixels in an electro-optic display device having a matrix of pixels arranged vertically in columns and horizontally in rows. This system includes:

(a) a digital signal source for producing a plurality of digital signals which change monotonically in value in successive steps during a frame cycle, and repeats such changes during a plurality of successive cycles;

(b) a digital-to-analog converter (DAC), connected to the digital signal source, for producing a voltage signal having a value corresponding to that of the digital signal;

(c) a number of column drivers, one for each column of the display device, which includes a track and hold circuit, coupled to the pixels in the respective column of the display device, for storing the voltage signal when it reaches a prescribed value corresponding to a particular brightness level of a pixel in the respective column and in a particular row during a given cycle;

(d) a column control circuit, coupled to all of the column drivers, for causing respective ones of the track and hold circuits to sample and store the voltage signal when it reaches the prescribed value for each respective column; and (f) a row control circuit for repeatedly selecting one or more pixel rows which receive the voltage signals stored in the track and hold circuits of the column drivers.

In a preferred embodiment of the invention, the column control circuit in this system includes:

(1) a number of column registers, one for each column of the display device, for storing a digital number corresponding to the desired brightness level of a pixel in the respective column;

(2) a control circuit coupled to the column registers for causing each column driver associated with a respective column to hold the voltage signal when it reaches a value corresponding to a digital number stored the column register associated with that column; and (3) an input circuit, coupled to the plurality of column registers, for supplying digital numbers to the column registers. The input circuit causes the digital numbers to alternate during a plurality of frame cycles between a number representing a value above, and a number representing a value below the desired brightness level of a pixel in each respective column when the desired brightness level falls between such two values.

With this arrangement, the average brightness level of each pixel is caused to approximate the desired brightness level although the numbers stored in the column register for each pixel may not represent a value that is equal to the desired brightness level. The end result is what may be called "temporal dithering"; that is, the interpolation between the brightness levels of each pixel in successive frames.

Advantageously, the input circuit for the column registers may be constructed so as to separately supply digital numbers to the odd column registers and to the even column registers and to phase shift the control signals for the two sets of column registers. In this way, the visibility of the temporal artifacts can be reduced.

In addition to providing temporal dithering, the column control circuit may be constructed to provide "spacial dithering"; that is, to alternate the brightness levels of two pixels in adjacent columns of the given row or two pixels in adjacent rows of a given column. As in the case with temporal dithering, the human eye can interpolate between these two adjacent pixels so that the brightness appears to be intermediate between the brightness of each pixel alone.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
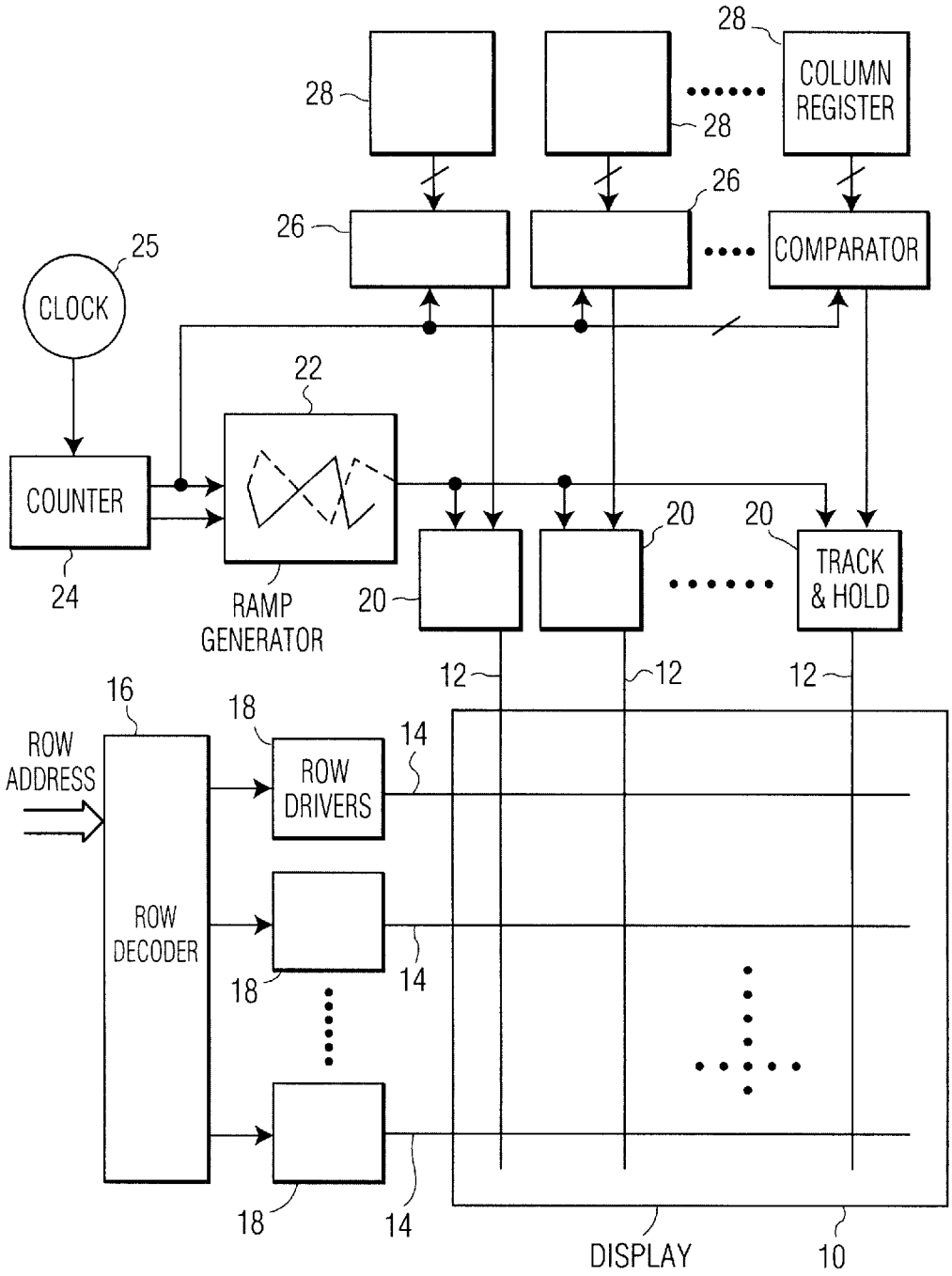
FIG. 1 PRIOR ART
FIG. 1 is a block diagram of an analog electro-optic light modulator panel, and its associated driver circuits, of the type to which the present invention relates.

The preferred embodiments of the present invention will now be described with reference to FIGS. 1–9 of the drawings. Identical elements in the various figures are designated with the same reference numerals.

FIG. 1 illustrates a typical arrangement for controlling and driving an electro-optic display device. In this arrangement, a liquid crystal display or light modulator 10 has a matrix of pixels arranged vertically in columns and horizontally in rows. These pixels are located at the intersections of the column conductors 12 and the row conductors 14. The column conductors 12 provide analog voltages to the pixels in each column whereas the row conductors 14 provide a switching voltage to each associated row, permitting the column voltages to be supplied to the pixels of that row.

Rows are successively addressed in a prescribed order by means of a row decoder 16 which activates successive ones of the row drivers 18.

Column voltages are supplied by column driver circuits 20 which are realized as track and hold circuits. These track and hold circuits receive a ramp voltage from a digital-to-analog converter (DAC) controlled ramp generator 22. The DAC 22 receives successive digital numbers from a counter 24 that counts pulses produced by a clock 25. The count commences either from some minimum number or maximum number and increases or decreases steadily until it reaches, at the opposite end of the scale, a maximum or minimum number, respectively. The DAC thus produces an increasing or decreasing ramp signal, in repetitive cycles, which approximates its digital input.

The output of the counter 24 is also supplied to a number of comparators 26, one for each column. This number is then compared in each comparator to a digital number representing the desired brightness level of a pixel in the associated column. The number representing this brightness level is stored in an associated pixel register 28 during each complete cycle of the system.

When the count supplied by the counter 24 is equal to the digital number stored in a pixel register, the respective comparator 26 produces a pulse which is passed to the track and hold circuit 20 for that column. Upon receiving such an enable pulse, the associated column driver 20 stores a voltage equal to the instantaneous output of the ramp generator 22.

Upon completion of each ramp cycle, the voltages stored in the column driver circuits are supplied to a pixel in a particular row selected by the row drivers 18.

Figure 2:
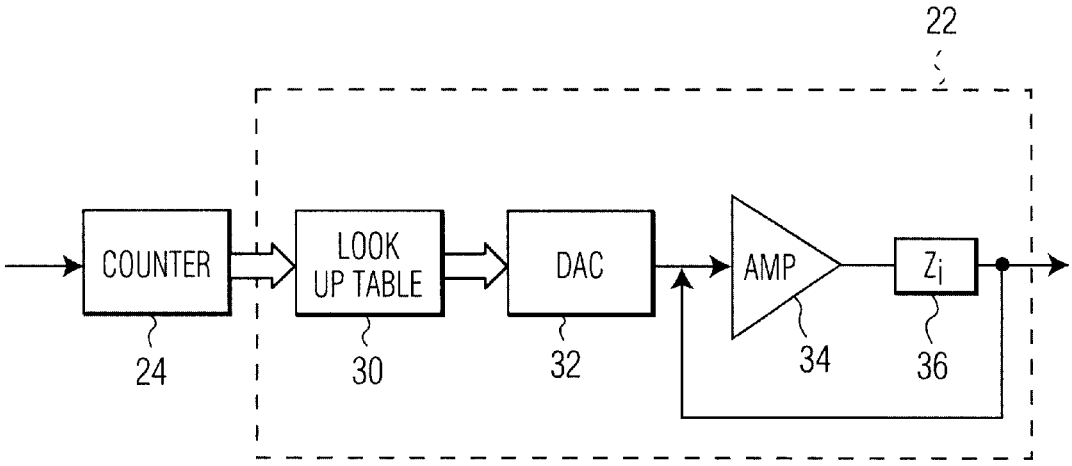
FIG. 2 PRIOR ART
FIG. 2 is a block diagram of a portion of the system of FIG. 1 showing details of the digital-to-analog converter (DAC) ramp generator.

FIG. 2 illustrates the ramp generator 22 in greater detail. In response to each clock pulse, the counter 24 increments its output which is supplied as an address to a look up table 30. The LUT supplies the contents of this address, a digital number, to a DAC 32. During the period between successive clock pulses, this DAC converts the digital number to an analog voltage signal which is passed globally to all column drivers 20 (FIG. 1) via a ramp buffer amplifier 34. This buffer amplifier serves to isolate the ramp waveform from the load and other disturbances. The low intrinsic output impedance $Z_i$ of the buffer output stage 36 is further reduced by feedback.

The operational speed of the system of FIG. 1 is limited by the conversion time of the DAC 32; that is, the minimum time within which the DAC can convert a digital number to an analog voltage.

Figure 3:
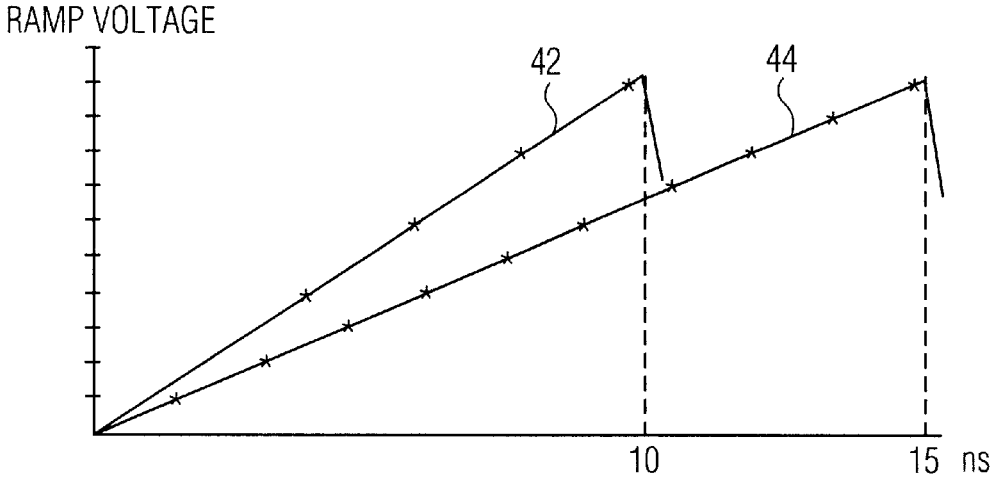
FIG. 3 is an explanatory diagram (not to scale) illustrating the operation of the DAC ramp generator of FIG. 2.

FIG. 3 shows a ramp voltage 40 (lower line) which has been generated from 10 digital numbers, each successively higher than the next. Since the total time allocated to this ramp 40 is 15 ns, each digital number must be supplied and converted within a time period of 1.5 ns. If this conversion time of 1.5 ns is the minimum time required by the DAC, the ramp 40 cannot be generated at a faster rate. This places an upper limitation on the frame rate of the system of FIG. 1.

According to the invention, the look up table 30 is programmed to provide larger voltage steps to the DAC in response to successive addresses received from the counter 24. This permits the ramp period to be reduced, as indicated by the ramp voltage 42 (upper line) in FIG. 3. As may be seen, the ramp 42 is generated in 5 steps rather than 10. Even though the entire ramp is generated in only 10 ns, rather than 15 ns as in the case of the ramp 40, the DAC conversion time, between the individual steps (indicated by an "x" on each ramp 40 and 42) is longer for the ramp 42 than for the ramp 40.

Although FIG. 3 shows a relatively course resolution for the ramps 40 and 42 (10 steps and 5 steps, respectively), it will be understood that in practice the ramp will be generated with a resolution of 256 steps (8 bits) or even greater (up to 10 bits).

The present invention makes it possible to increase the frame rate of the system without sacrificing display performance or increasing cost. Although it would be possible to provide two DACs and to alternate their use for odd and even rows of the display device, such a modification would substantially increase the cost of the display.

According to the invention, the resolution of the DAC is reduced by dropping one (or more) input bits from the look up table 30 and restoring the resolution (grey scale) of the display by temporal dithering; i.e., interpolation through averaging by the human visual system of a variable brightness produced by the DAC in successive frames.

Figure 4:
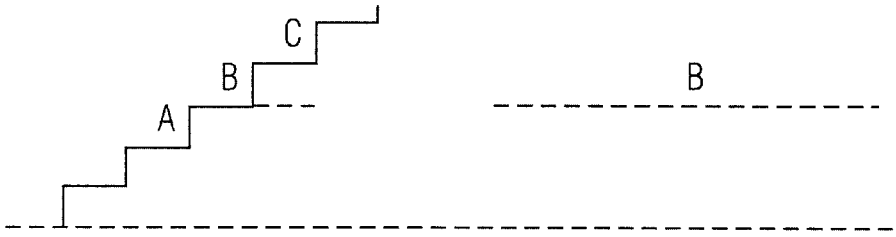
FIG. 4 is a time diagram illustrating the operation of the system of FIG. 1 with a full-resolution DAC.
Figure 5:
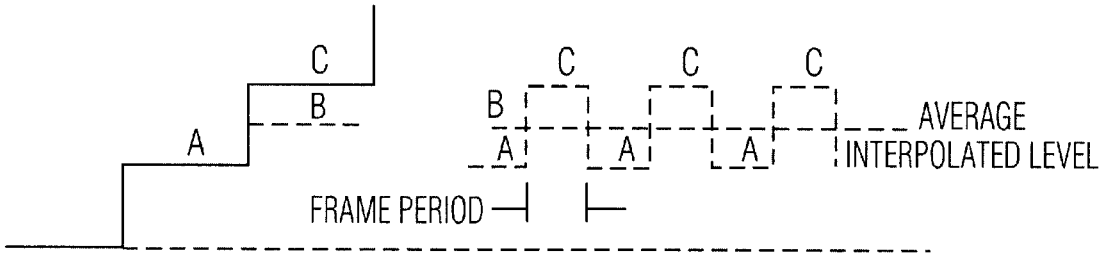
FIG. 5 is a time diagram illustrating the operation of the system of FIG. 1 with a half-resolution DAC in accordance with the invention.

An example of this scheme, according to the invention, is shown in FIGS. 4 and 5. FIG. 4 shows the present, known technique whereby a high resolution waveform is created by a series of closely spaced analog levels—e.g., A, B and C—which is provided to and tracked by the column drivers of the display. If the desired brightness of a pixel in a particular column is B, for example, the column driver will sample (store) the analog voltage when it reaches the level B.

FIG. 5 shows a courser ramp waveform having fewer steps, A and C, which is tracked by the column drivers. This waveform enables storing of the corresponding levels A and C but not the desired voltage B. According to the invention, the column driver circuits store the levels A and C, respectively, during alternate frame periods, thus creating an average analog level equivalent to B.

Because this system can support very high frame rates, well beyond the perception limit for 100% flicker, the brightness modulation associated with a least significant bit (LSB) corresponding to 1 percent is practically assured to be unnoticeable.

This scheme of temporal dithering can be further refined by dithering pixels in adjacent columns or rows, e.g., by alternating the phase of adjacent pixels. In this way, the temporal dithering can be supplemented with spacial dithering as is disclosed, for example, in the U.S. Pat. No. 5,189,406, which patent is incorporated by reference.

Figure 6:
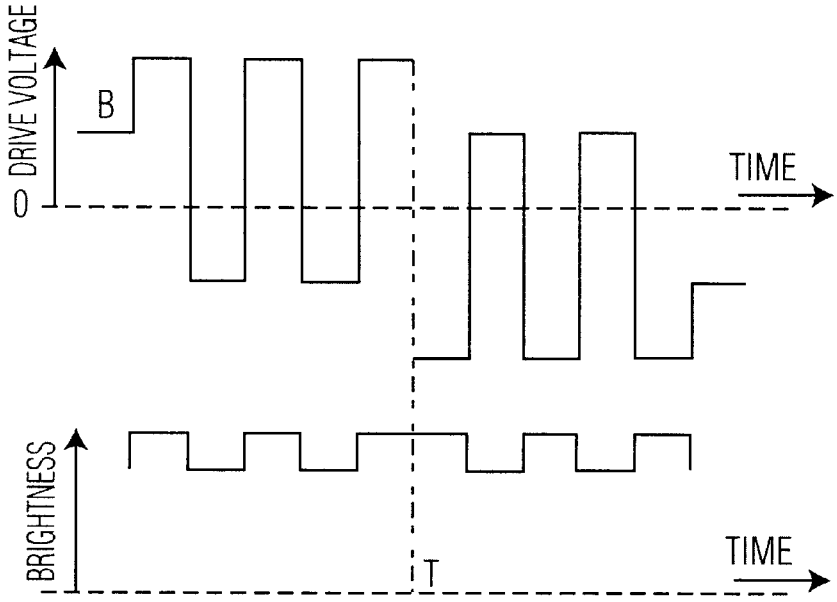
FIG. 6 is a time diagram showing a change of phase in the drive waveform (upper diagram) to avoid DC build up on the opto-electronic display device and showing the resulting brightness modulation for a pixel (bottom diagram).

Since the pixel of the electro-optic (liquid crystal) display device must be supplied with a purely analog voltage, it is necessary to periodically invert the polarity, advantageously from frame to frame, in order to prevent DC build up, however small. Since the temporal dithering process is synchronous with each frame, the pixel phase is changed regularly as is illustrated in FIG. 6.

The phase of the drive waveform (upper diagram in FIG. 6) is repeatedly changed, as shown at time T. This results in a brightness modulation of the respective pixel (lower diagram). The phase transitions can be designed to occur at a different moment for different pixels or groups of pixels. In this way the transitions are no longer global and, thus, less likely to be noticeable.

Since dithering represents modulation at the lowest bit level—i.e., brightness modulation in the order of 1% in the case of 8 bit data—the visual effect of dithering is small so that great freedom exists in the realization of this scheme.

The temporal dithering process can be implemented, without changes to the electro-optic display itself, by modifying the data sent to the column registers of the display device and increasing the DAC step size by changing the data in its look up table 30.

A technique for a two bit dithering, resulting in four interpolation steps, will now be described in connection with FIGS. 7 and 8.

Let integer N, 0 N 255, represent the original (8 bit) data word. N can be broken down into a more significant 6 bit part M and a less significant 2 bit part L. Hence:

$$N=M\cdot 4+L,$$

where0 M 64 and0 L 3

In an interval spanning four frames, a different number i in each of the four frames is added to the data word N, where i represents the sequence (0, 1, 2, 3) or any permutation thereof. This process is repeated in the next four frame periods, with the same or a different permutation of i, and so forth.

As before, the new data word value N_new=(N+i) can be written as:

$$N_\text{new}=M_\text{new}\cdot 4+L_\text{new}=M\cdot 4+L+i \text{ for } L+i \text{ ▒} 4$$

$$N_\text{new}=M_\text{new}\cdot 4+L_\text{new}=(M+1)\cdot 4+(L+i-4) \text{ for } L+i\ 4$$

which is simply a carry-over from the less significant part L to the more significant part M. The value of the more significant part is further limited to 63 (6 bits) by clipping the data (thereby reducing the ultimate resolution from 256 to 253 levels):

$$M_\text{new}\ 63 \text{ if } M=63$$

Next, the new word is truncated to 6 bits by dropping the less significant part L (two bits) and expanded to 8 bits again by adding two leading zeros. The latter plus the clipping ensures that the 8 bit counter, counting only 64 clock cycles in a conversion period, will match all 64 possible data values.

Figures 7, 8:
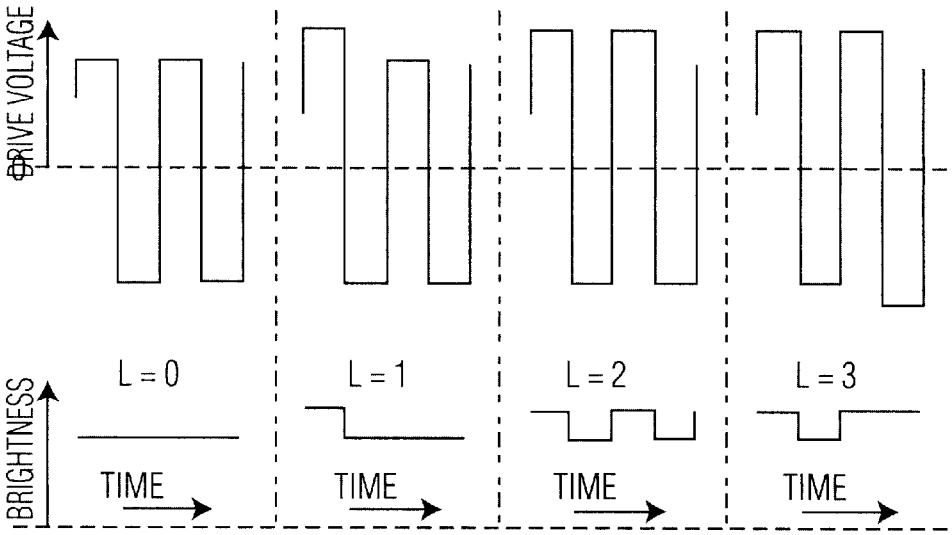
FIG. 7 is a table illustrating how two discrete levels, M and M+1, may be sampled to provide a four level data interpolation scheme for a pixel.
FIG. 8 illustrates the drive waveform upon inversion (upper diagram) and the brightness waveform (lower diagram) for the four level interpolation scheme.

This four level data interpolation scheme is illustrated in the table of FIG. 7 and in the time diagrams of FIG. 8. In FIG. 7, interpolation is achieved by sampling two discrete levels, M and M+1, in proportion to the value of the two lower bits. The table of FIG. 7 shows the sampled values of M_new for each of the four frames.

FIG. 8 illustrates the drive waveform (upper time diagram) after inversion and the brightness waveform (lower diagram) for this four level data interpolation scheme.

Figure 9:
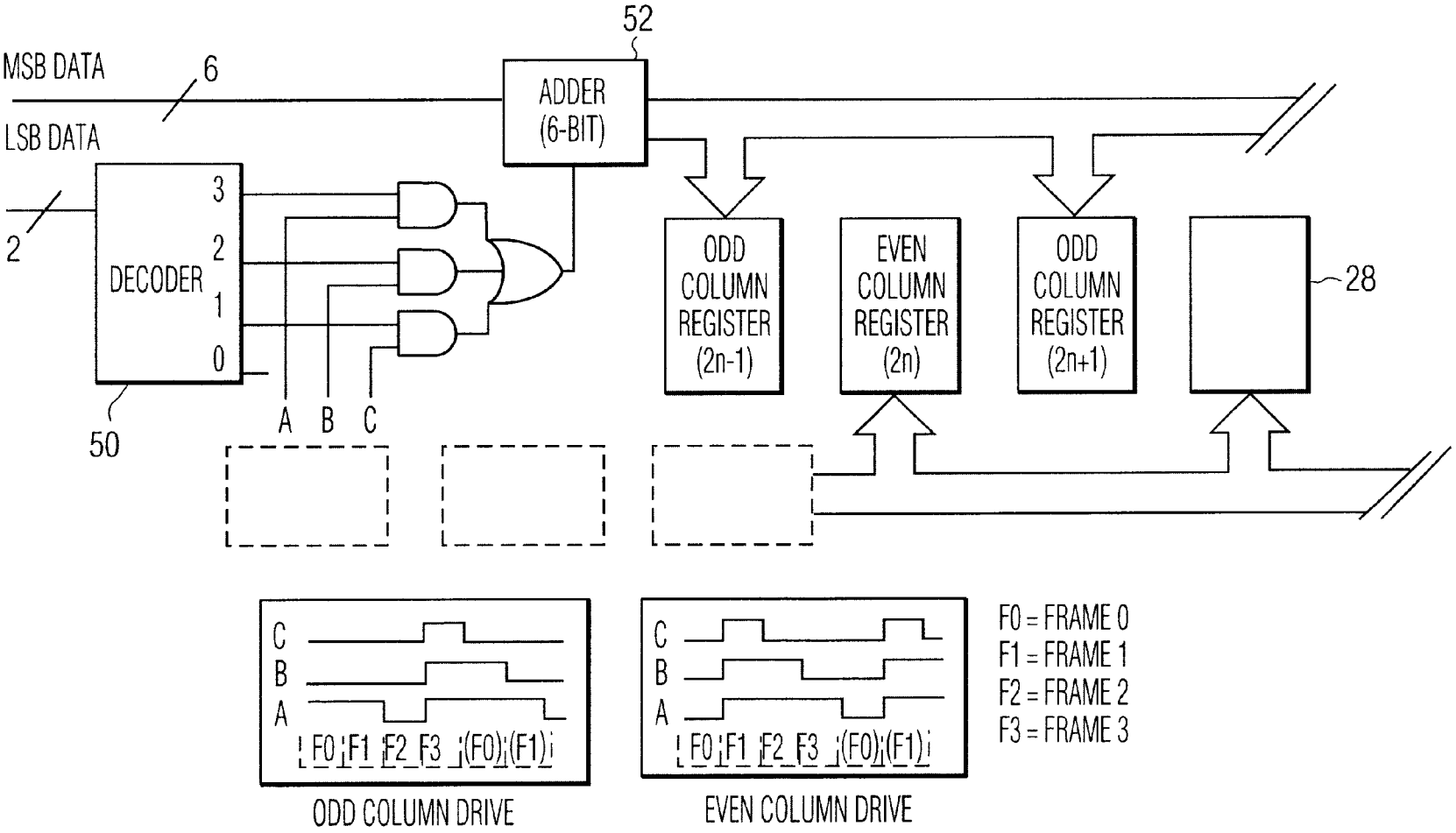
FIG. 9 is a block diagram of the preferred embodiment of a column control circuit for the system of FIG. 1.

FIG. 9 shows a preferred embodiment of a device for implementing the temporal dithering scheme. In this embodiment, it is assumed that the look up table 30 has been programmed to provide the DAC 32 with larger steps between successive conversion cycles. The less significant bit data (2 bits) are decoded in a decoder 50, providing output signals at one of four output terminals (0, 1, 2 and 3). This decoded LSB data is added to the MSB data under control of global control signals A, B and C, which are indicated in the legends at the bottom of the diagram. Control signals for the odd column registers and the even column registers are phase shifted with respect to each other to reduce the visibility of temporal artifacts.

As shown in the upper part of the diagram, the output of the adder 52 is passed to the odd column registers. Identical hardware is provided, as shown in dashed lines in the lower part of the diagram, to supply data to the even column registers.

There has thus been shown and described a novel apparatus having a DAC-controlled ramp generator for applying voltages to individual pixels in a color electro-optic display device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An apparatus for applying various levels of voltage to individual pixels in a display device having a matrix of pixels arranged vertically in columns and horizontally in rows, said apparatus comprising:

(a) a digital signal source for producing a plurality of digital signals which change monotonically in value in successive steps during a frame cycle, and repeat such changes during a plurality of successive cycles;

(b) a digital-to-analog converter (DAC), connected to said digital signal source, for producing a voltage signal having a value corresponding to that of said digital signal;

(c) a plurality of column drivers, each column driver being associated with a column of the display device and including a track and hold circuit, coupled to the pixels in the respective column of said display device, for storing said voltage signal when it reaches a prescribed value, said prescribed value corresponding to a particular brightness level of a pixel in the respective column and in a particular row during a given cycle;

(d) a column control circuit, coupled to said column drivers, for causing respective ones of said track and hold circuits to store said voltage signal when it reaches said prescribed value for each respective column; and;

(f) a row control circuit for repeatedly selecting one or more pixel rows which receive the voltage signals stored in said track and hold circuits of said column drivers;

the improvement wherein said column control circuit comprises:

(1) a plurality of column registers, each column register being associated with a column of said display device, for storing a digital number corresponding to the desired brightness level of a pixel in the respective column;

(2) a control circuit coupled to the column registers for causing each column driver associated with a respective column to hold the voltage signal when it reaches a value corresponding to a digital number stored the column register associated with that column; and (3) an input circuit, coupled to said plurality of column registers, for supplying digital numbers to said column registers, said input circuit causing said digital numbers to alternate during a plurality of frame cycles between a number representing a value above, and a number representing a value below the desired brightness level of a pixel in each respective column when the desired brightness level falls between such two values.

2. The apparatus defined in claim 1, wherein said input circuit comprises a first portion and a second portion, said first portion supplying said digital numbers to some of said column registers and said second portion supplying said digital numbers to other ones of said column registers.

3. The apparatus defined in claim 1, wherein said column control circuit is operative to repeatedly alternate the voltage signal values applied to two pixels in adjacent columns of a given row, thereby to create a brightness level for said two pixels which appears to be intermediate between the brightness of each pixel alone.

4. The apparatus defined in claim 1, wherein said row control circuit is operative to repeatedly alternate the voltage signal values applied to two pixels in adjacent rows of a given column, thereby to create a brightness level for said two pixels which appears to be intermediate between the brightness of each pixel alone.

* * * * *